US009211734B2

(12) United States Patent
Saikawa et al.

(10) Patent No.: US 9,211,734 B2
(45) **Date of Patent: *Dec. 15, 2015**

(54) PAPER WIDTH DETECTION METHOD FOR A LABEL PRINTER, PRINTING CONTROL METHOD FOR A LABEL PRINTER, AND A LABEL PRINTER

(71) Applicant: Seiko Epson Corporation, Tokyo (JP)

(72) Inventors: Takashi Saikawa, Shiojiri (JP); Hideki Nishimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/188,076

(22) Filed: Feb. 24, 2014

(65) Prior Publication Data

US 2014/0167344 A1 Jun. 19, 2014

Related U.S. Application Data

(63) Continuation of application No. 12/512,384, filed on Jul. 30, 2009, now Pat. No. 8,714,688.

(30) Foreign Application Priority Data

Jul. 30, 2008 (JP) ..... 2008-195869
Jul. 30, 2008 (JP) ..... 2008-195870

(51) Int. Cl.
*B41J 11/00* (2006.01)
*B41J 3/407* (2006.01)
*B41J 11/42* (2006.01)

(52) U.S. Cl.
CPC ..... *B41J 11/0095* (2013.01); *B41J 3/4075* (2013.01); *B41J 11/003* (2013.01); *B41J 11/42* (2013.01)

(58) Field of Classification Search
None
See application file for complete search history.

(56) References Cited

U.S. PATENT DOCUMENTS 6,123,796 A * 9/2000 Kathmann et al. ..... 156/249
6,622,625 B1 9/2003 Sugiyama (Continued)

FOREIGN PATENT DOCUMENTS

CN 1371325 A 9/2002
CN 1737747 A 2/2006

(Continued)

OTHER PUBLICATIONS

European Search Report on Jan. 7, 2011 (App. No. 09166650.3—5 Pages).

(Continued)

*Primary Examiner* — Justin Seo
(74) *Attorney, Agent, or Firm* — Nutter McClennen & Fish LLP; John J. Penny, Jr.; Derek Roller

(57) ABSTRACT

When a label printer detects the paper width, the paper width detection operation scans the transportation path in the paper width direction by the paper width detector not once but twice, and conveys the recording medium transportation distance L, which is longer than the gap length of the gap between labels and is shorter than the label length of each label, between the first and second paper width detection operations. Of the two positions detected as the left edge of the recording medium in the first and second detection operations, the position that is farthest left is used. Likewise, of the two positions detected as the right edge of the recording medium in the first and second detection operations, the position that is farthest right is used.

8 Claims, 8 Drawing Sheets

(56) References Cited

U.S. PATENT DOCUMENTS

| | | | | |
|---|---|---|---|---|
| 2005/0056180 | A1 | 3/2005 | Noda et al. | |
| 2006/0039022 | A1 | 2/2006 | Kondo | |
| 2006/0115313 | A1 * | 6/2006 | Shaw, III | 400/621 |
| 2009/0224020 | A1 | 9/2009 | Oi et al. | |
| 2010/0026738 | A1 | 2/2010 | Saikawa et al. | |

FOREIGN PATENT DOCUMENTS

| | | | |
|---|---|---|---|
| EP | 0 665 115 | A2 | 8/1995 |
| JP | 01-267143 | A | 10/1989 |
| JP | 02-279374 | A | 11/1990 |
| JP | 05-208530 | A | 8/1993 |
| JP | 06-031984 | A | 2/1994 |
| JP | 07-020780 | A | 1/1995 |
| JP | 10-062559 | A | 3/1998 |
| JP | 11-337314 | A | 12/1999 |
| JP | 2001-175799 | A | 6/2001 |
| JP | 2001-180631 | A | 7/2001 |
| JP | 2001-180632 | A | 7/2001 |
| JP | 2002-127521 | A | 5/2002 |
| JP | 2002-308242 | A | 10/2002 |
| JP | 2007-039140 | A | 2/2007 |
| JP | 2007-216515 | A | 8/2007 |
| WO | 95/15738 | A1 | 6/1995 |

OTHER PUBLICATIONS

Translation of JP 2002-127521. (JP 2002-127521 A was published on May 8, 2002).

* cited by examiner

PAPER WIDTH DETECTION METHOD FOR A LABEL PRINTER, PRINTING CONTROL METHOD FOR A LABEL PRINTER, AND A LABEL PRINTER

Priority is claimed under 35 U.S.C. §120 to U.S. patent application Ser. No. 12/512,384 filed on Jul. 30, 2009, 35 U.S.C. §119 to Japanese Patent Applications No. 2008-195869 filed on Jul. 30, 2008, and No. 2008-195870 filed on Jul. 30, 2008, the disclosures of which, including the specification, drawings and claims, are incorporated herein by reference in their entireties.

BACKGROUND

1. Technical Field

The present invention relates to a paper width detection method used in a label printer to accurately detect the paper width of a recording medium, a printing control method for a label printer for printing to a recording medium based on the paper width detected by said paper width detection method, and to a label printer.

2. Related Art

Printers that print to a recording medium such as label paper having labels affixed at a constant interval along a long web liner are known from the literature. Such printers detect the width of either the recording medium liner or the labels affixed thereto by a detection operation using a paper width detector disposed to the transportation path through which the recording medium is conveyed, and by control of the other parts of the printer for printing based on the detection result. An optical sensor is commonly used as the paper width detector, and the width of the liner portion or the label portion of the recording medium is detected by emitting a detection beam to the recording medium liner or label and detecting the light that passed through or the light that is reflected.

Japanese Unexamined Patent Appl. Pub. JP-A-2007-216515 teaches a printing device having an image sensor head and a reflector member disposed above and below the label paper. The image sensor head has optical elements arrayed at a density of 300 dpi, and the image sensor head and reflector are wider than the label width. This configuration emits a detection beam from the image sensor head toward the label paper and detects the light reflected from the reflector or from the label by the optical elements of the image sensor head to detect labels of different widths.

Methods that detect the recording medium width based on change in the reflectivity or transmittance when scanning across the width of the recording medium cannot differentiate the change in reflectivity or change in transmittance caused by punch holes, soiling, or damage to the recording medium from a change in reflectivity or change in transmittance at the edge of the recording medium, and can therefore result in detection errors.

Furthermore, because the amount of light that is reflected back by the liner is low when the recording medium uses a transparent liner or a liner with low reflectivity, such as a black liner, the point where the reflectivity changes near the edge of the liner can be difficult to detect. The change in transmittance near the edge of the liner can also be difficult to detect with a recording medium that has a liner with high transmittance, such as a transparent liner. Erroneous detection or a detection error reporting that the edge of the recording medium could not be detected may therefore result.

If the label paper has the labels affixed to a liner for which the edges can be difficult to detect, the likelihood of being able to detect at least the width of the labels is high if the paper width detection process is executed when the labels are at the paper width detection position. However, if the paper width is detected when the gap between labels (the portion of the liner between adjacent labels) is at the paper width detection position, the edges of the liner and the edges of the label cannot be detected, and an error reporting that the paper width could not be detected may result.

In the case of die-cut labels, cuts and voids can be formed by the die around the labels as a result of the stamping process. The reflectivity therefore changes sharply in such voids, and the void may be falsely detected as the edge of the liner. The likelihood of such detection errors is particularly high with die-cut label paper when the labels are affixed to a liner for which detecting the edges can be difficult, such as a transparent liner or black liner. In such situations the width of only the part (that is, the waste matrix part, the excess portion left after the labels are removed in the production process) of the liner on the left and right sides of the label may be wrongly detected as the width of the recording medium.

SUMMARY

A first object of the present invention is to provide a label printer and a paper width detection method for a label printer that can determine the paper width of a recording medium more accurately than the related art using a paper width detector.

A further object of the invention is to provide a label printer and a printing control method for a label printer that, based on the determined paper width, controls printing more accurately than the related art.

A first aspect of an embodiment of the invention is a paper width detection method for a label printer, including a first paper width detection step of scanning a paper width detector in a paper width direction and detecting a left edge position and a right edge position of a recording medium at a predetermined position on a transportation path for conveying a recording medium having a liner with labels removably affixed thereto; a paper transportation step of conveying the recording medium a distance that is shorter than the transportation direction length of the label and is longer than the gap between labels; a second paper width detection step of scanning the paper width detector in the paper width direction and detecting a left edge position and a right edge position of the recording medium; and a paper width determination step of determining the paper width of the recording medium based on the detection result of the first paper width detection step and the detection result of the second paper width detection step.

When the recording medium is label paper, paper width detection methods that execute the detection operation only once may detect the paper width when the gap between labels is located at the paper width detection position. Anticipating the presence of this gap between labels, the embodiment of the invention executes the detection operation at least twice while conveying the recording medium a distance that is at least greater than the length of the gap between labels and is shorter than the label length between the two detection operations. As a result, detection values can be obtained at least once when a label is at the paper width detection position. Therefore, even if the recording medium uses a liner that is difficult for the paper width detector to detect the edges of, the possibility of being able to detect at least the width of the labels is high. The error of being unable to detect the paper width (a paper width detection failure) therefore does not occur easily. The paper width can therefore be detected more accurately than with the related art.

In according to another aspect of an embodiment of the invention the paper width determination step selects the position that is farthest to the left from among the left edge positions detected in the first and second paper width detection steps as the left edge position of the recording medium, and selects the position that is farthest to the right from among the right edge positions detected in the first and second paper width detection steps as the right edge position of the recording medium.

Alternatively, the paper width determination step may compare a first width calculated from the left edge position and the right edge position detected in the first paper width detection step with a second width calculated from the left edge position and the right edge position detected in the second paper width detection step, and use the greater value as the paper width of the recording medium.

If a method that compares the results of two paper width detection operations is used and an accurate paper width can be detected in at least one of the two operations, that value can be used. The paper width can therefore be detected more accurately than in the related art. In addition, if a method that compares the left edge positions and the right edge positions from two detection results is used, and an accurate right edge position or left edge position can be detected in at least one of the two detection results, that value can be used. The detection accuracy of the right edge position or left edge position can therefore be improved, and the paper width can be detected more accurately than when the paper widths are simply compared.

In the first paper width detection step and the second paper width detection step of the paper width detection method for a label printer according to another aspect of an embodiment of the invention, the scanning range of the paper width detector is a range including the maximum paper width of the recording medium that may be conveyed through the transportation path, and of the scanning positions where change greater than or equal to a predetermined amount appears in the output of the paper width detector, the position at the farthest left side is detected as the left edge position and the position at the farthest right side is detected as the right edge position.

Alternatively, in the first paper width detection step and the second paper width detection step, the scanning range of the paper width detector is a range including the maximum paper width of the recording medium that may be conveyed through the transportation path, and of the scanning positions where change greater than or equal to a predetermined amount appears in the output of the paper width detector, the first position in the scanning direction of the paper width detector is detected as one edge position of the recording medium, and the last position in the scanning direction is detected as the other edge position of the recording medium.

Another aspect of an embodiment of the invention is a paper width detection method for a label printer, including steps of scanning a paper width detector in a paper width direction through a range including the maximum paper width of a recording medium at a predetermined position on a transportation path for conveying a recording medium having a liner with labels removably affixed thereto; and selecting, from among the scanning positions where change greater than or equal to a specific amount appears in the output of the paper width detector, the position farthest to the left side as the position of the left edge of the recording medium, and the position farthest to the right side as the position of the right edge of the recording medium.

Alternatively, a paper width detection method for a label printer according to according to another aspect of an embodiment of the invention has a paper width detection step of scanning a paper width detector in a paper width direction through a range including the maximum paper width of a recording medium at a predetermined position on a transportation path for conveying a recording medium having a liner with labels removably affixed thereto, and selecting, from among the scanning positions where change greater than or equal to a specific amount appears in the output of the paper width detector, the first position in the scanning direction of the paper width detector as the position of one edge of the recording medium, and the last position in the scanning direction as the position of the other edge of the recording medium.

The paper width detection methods for a label printer according to these aspects of an embodiment of the invention set the scanning range of the paper width detector to exceed the maximum paper width of the recording medium, and detect the position where the output value of the paper width detector changes in this scanning range. The locations where the output value changed that are closest to the left edge and right edge of the scanning range are selected as the left edge and right edge of the recording medium. Alternatively, the location of the first change in the output value and the location of the last change in the output value in the scanning direction when scanning through this scanning range are selected as the edges of the recording medium. If the recording medium is soiled or damaged, or there are cuts from the die-cutting process, the output value of the paper width detector will change greatly at those locations and may be detected as a change in the output value. However, because there will always be a location farther to the left or the right of such soiling or damage where the output value changes due to an edge of the recording medium, the likelihood of the method of the embodiment of the invention mistakenly identifying the position of such soiling, damage, or die-cut marks as the position of the left or right edge of the recording medium is low. Therefore, insofar as an edge part of the recording medium is detected as a point of change in the output value of the paper width detector, the edges of the recording medium can be accurately detected and the paper width can be accurately detected. The paper width detection accuracy is therefore improved.

Another aspect of an embodiment of the invention has a positioning step of conveying the recording medium forward through the transportation path so that the printing start position of the recording medium is positioned to the position of the print head. The first paper width detection step is executed after the printing start position of the recording medium is positioned by the positioning step; and the paper transportation step conveys the recording medium a predetermined distance in reverse and positions the predetermined printing start position of the label located at the leading end of the recording medium to the print head position. This aspect of the embodiment of the invention can detect the paper width in conjunction with the paper positioning operation.

Further preferably, in the paper width detection method for a label printer according to another aspect of an embodiment of the invention the paper width detector is an optical reflection detector; and the paper width detector is mounted on a carriage for moving the print head bidirectionally in the paper width direction. This enables detecting the paper width using a simple configuration.

In a paper width detection method for a label printer according to another aspect of an embodiment of the invention the recording medium is die-cut label paper having labels formed by a die-cut process affixed to a transparent liner; and process marks of a specific depth resulting from the die-cut process may be formed around the outside edges of the labels in the transparent liner.

When there are process marks left by the die-cut label making process, the output value of the paper width detector may change greatly at these marks, and the location where this change occurs may be detected as a position of change in the detector output value. However, because the changes in the output value at the edges of the liner are closer to the edges of the scanning area than such die-cut marks, the likelihood of mistakenly recognizing such die-cut process marks as the left or right edge of the recording medium is low. Paper width detection errors resulting from die cutting the labels can be prevented.

Another aspect of an embodiment of the invention is a printing control method for a label printer including a paper width determination step of determining a paper width of the recording medium by the paper width detection method for a label printer according to the embodiment of the invention; and a paper size determination step of comparing the determined paper width obtained by the paper width determination step and the specified paper width of the recording medium received from an external device, and detecting a paper size error when the specified paper width differs from the determined paper width.

A printing control method for a label printer according to another aspect of an embodiment of the invention has a masking step of comparing the determined paper width with the specified printing width of the print data received from an external device, and applying a masking process to at least the part of the print data exceeding the specified paper width if the specified printing width is greater than the determined paper width.

As described above, the printing control method for a label printer according to an embodiment of the present invention can more accurately detect paper size errors by comparing the paper width of the recording medium determined by the paper width detection method described above with the specified paper width of the recording medium. In addition, by processing so that at least the part of the print data outside the bounds of the paper width does not print when a paper size error occurs, soiling the platen with ink can be prevented.

Another aspect of and embodiment of the invention is a label printer including a paper width detector; a carriage transportation mechanism and a carriage that carries the paper width detector; a recording medium transportation mechanism that conveys a recording medium; and a control unit that controls the recording medium transportation mechanism, the carriage transportation mechanism, and the paper width detector, and determines the paper width of the recording medium using the paper width detection method for a label printer according to at least one embodiment of the invention.

In a label printer according to another aspect of an embodiment of the invention, the control unit controls printing by the printing control method for a label printer according to the invention.

This aspect of an embodiment of the invention can determine the paper width of the recording medium more accurately than the related art, and can control the parts of the label printer based on the determined paper width. The invention can also detect paper size errors more accurately than the related art, and can apply a masking process to the print data.

Other objects and attainments together with a fuller understanding of embodiments of the invention will become apparent and appreciated by referring to the following description and claims taken in conjunction with the accompanying drawings.

DETAILED DESCRIPTION

A label printer and a paper width detection method for the label printer according to preferred embodiments of the present invention are described below with reference to FIG. 1 to FIG. 8.

General Configuration

Figure 1:
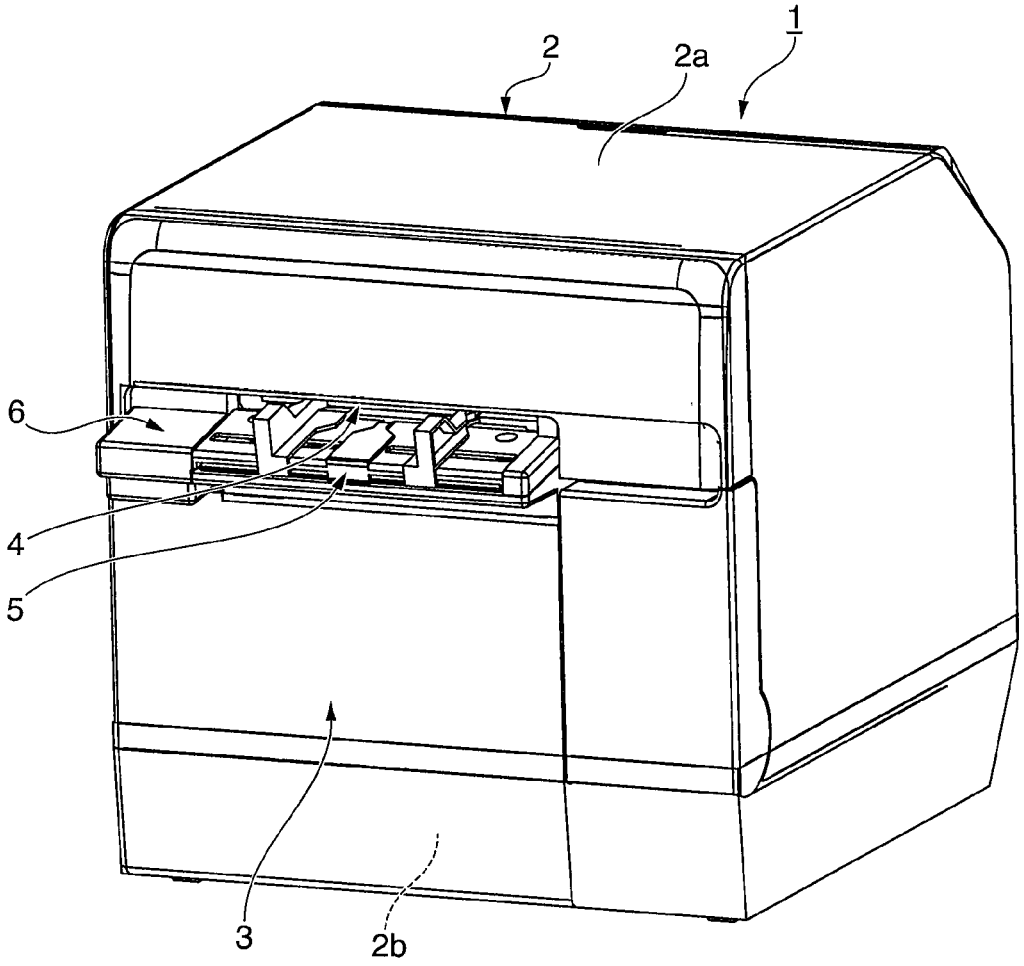
FIG. 1 is an external oblique view of a label printer according to a preferred embodiment of the invention.
Figure 2:
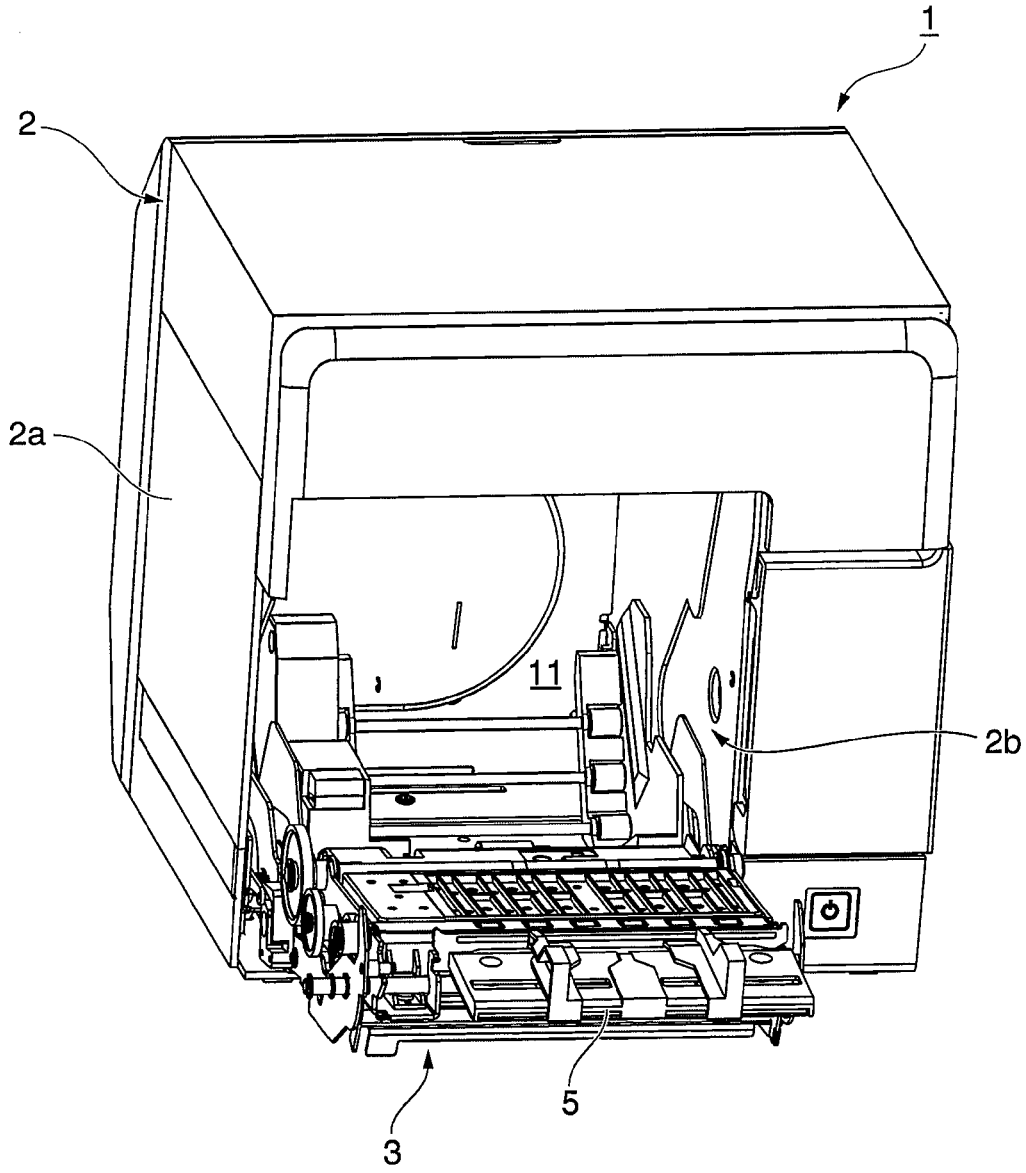
FIG. 2 is an external oblique view of the label printer with the access cover open.

FIG. 1 is an oblique view showing an inkjet label printer according to a first embodiment of the invention. FIG. 2 is an oblique view of the label printer with the cover completely open.

The label printer 1 has a rectangular box-like body 2 and a cover 3 that opens and closes and is disposed to the front of the body 2. A paper exit 4 of a predetermined width is formed at the front of the outside case 2*a* part of the printer body 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3.

Operating the cover opening lever 6 unlocks the cover 3. When the exit guide 5 is pulled forward after the lock is released, the cover 3 pivots at the bottom end part thereof and opens forward to a substantially horizontal position. As shown in FIG. 2, when the cover 3 opens, the roll paper compartment 11 formed inside the printer opens, and the transportation path A (denoted by the bold dot-dash line in FIG. 3) from the roll paper compartment 11 to the paper exit 4 also opens at the same time. Note that the cover case of the cover 3 and the cover opening lever 6 are not shown in FIG. 2.

Figure 3:
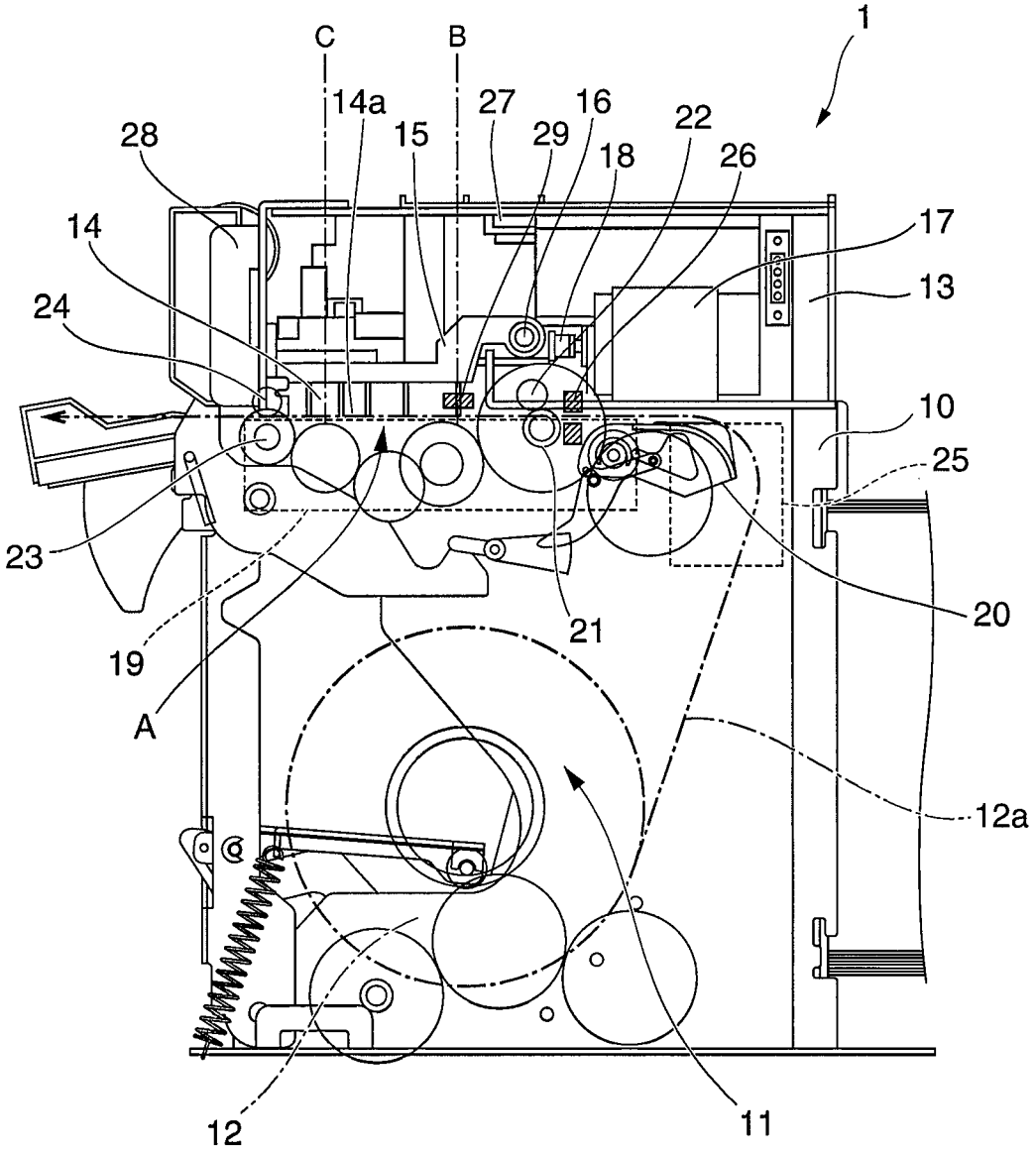
FIG. 3 is a vertical section view showing the internal structure of the label printer.

FIG. 3 shows the internal configuration of the label printer 1. Roll paper 12 is stored inside the roll paper compartment 11 so that the roll paper 12 can roll on its side between the sides of the printer. The roll paper 12 is a continuous web of paper 12*a* of a constant width wound into a roll.

A head unit frame 13 is disposed horizontally at the top of the printer frame 10 above the roll paper compartment 11. Disposed to the head unit frame 13 are an inkjet head 14, a carriage 15 that carries the inkjet head 14, and a carriage guide shaft 16 that guides movement of the carriage 15 widthwise to the printer. The carriage guide shaft 16 is disposed horizontally widthwise to the printer. The inkjet head 14 is mounted on the carriage 15 with the ink nozzle surface 14*a* facing down. A carriage transportation mechanism including a carriage motor 17 and timing belt 18 for moving the carriage 15 bidirectionally along the carriage guide shaft 16 is disposed above the roll paper compartment 11.

A platen 19 extending horizontally widthwise to the printer is disposed below the inkjet head 14 with a constant gap to the ink nozzle surface 14*a*. The platen 19 determines the printing position of the inkjet head 14. A tension guide 20 that curves downward is attached on the back side of the platen 19. The tension guide 20 is urged upward by a spring force.

A rear paper feed roller 21 and a rear paper pressure roller 22 are disposed horizontally widthwise to the printer behind the platen 19 (that is, on the upstream side in the transportation direction). The rear paper pressure roller 22 is pressed from above with a predetermined force to the rear paper feed roller 21 with the recording medium 12*a* therebetween. A front paper feed roller 23 and front paper pressure roller 24 are disposed on the front side of the platen 19 (downstream in the transportation direction). The front paper pressure roller 24 is pressed from above to the front paper feed roller 23 with the paper 12*a* therebetween. The rear paper feed roller 21 and the front paper feed roller 23 are rotationally driven synchronously by the paper transportation motor 25 disposed to the printer frame 10.

The paper 12*a* pulled from the roll paper 12 in the roll paper compartment 11 is set with predetermined tension applied by the tension guide 20 through the transportation path A passed the printing position and out from the paper exit 4. When the paper transportation motor 25 is driven with the paper 12*a* thus loaded, the rear paper feed roller 21 and front paper feed roller 23 turn and the paper 12*a* is conveyed a predetermined distance. The inkjet head 14 is also driven synchronized to the conveyance of the paper 12*a* to print on the surface of the paper 12*a* as it passes the printing position. Paper transportation is then stopped with the printed portion of the paper 12*a* hanging out from the paper exit 4, the printed portion of the paper 12*a* is cut by the paper cutter 28 disposed near the paper exit 4, and the printed portion of the paper is discharged.

Configuration of the Recording Paper

Figure 5A:
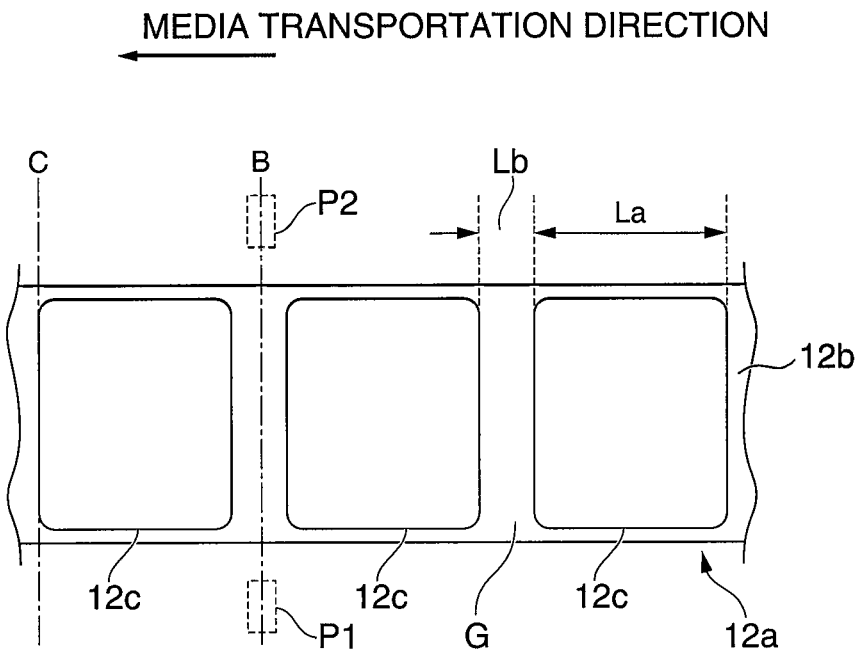
FIG. 5A and FIG. 5B describe the paper width detection method used in the label printer.
Figure 5B:
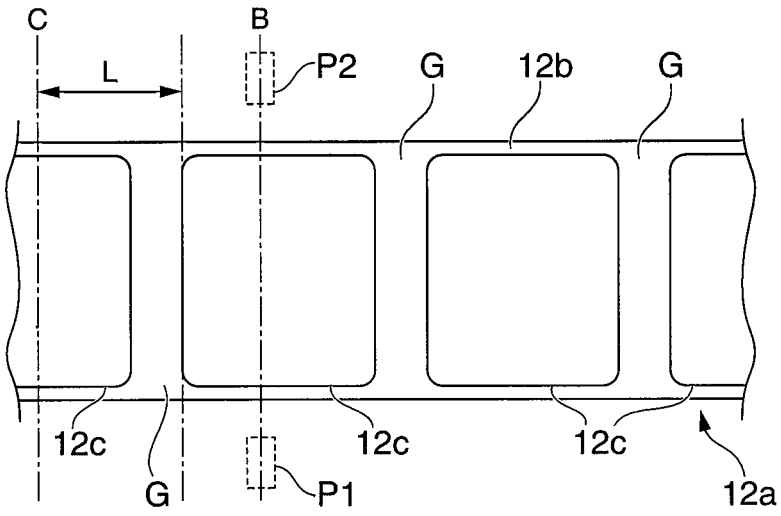

As shown in FIG. 5A and FIG. 5B, the paper 12*a* includes a long web of backing paper 12*b* and opaque labels 12*c* that are removably affixed to the surface of the backing paper 12*b* and do not transmit the detection beam emitted. The backing paper 12*b* is a liner with low reflectivity to the detection beam from the detectors described below, and in this embodiment of the invention is a transparent liner of a material such as plastic film or synthetic paper that passes the detection beam and is processed into a long continuous web of a constant width. The labels 12*c* are adhesive labels made of a white or other non-transparent material, and surface processing appropriate to inkjet printing is applied to the surface of the labels 12*c*. The labels 12*c* are formed so that the label length La, which is the length in the longitudinal direction (transportation direction) of the paper 12*a*, is constant, and the gap length Lb, which is the length in the transportation direction of the label gap G (the part of the liner between adjacent labels), is constant.

The paper 12*a* is die-cut label paper, and the labels 12*c* are cut while affixed to the backing paper 12*b* using a die-cut press. Slit-like process marks are thus formed by the die cutter (stamp) along the edges of the labels 12*c* in the backing paper 12*b*. The labels 12*c* are affixed centered to the paper width of the backing paper 12*b* or liner, and the width of the labels 12*c* is slightly shorter than the width of the backing paper 12*b*. Only a narrow strip of backing paper 12*b* (the waste matrix, the excess left after removing the labels in the manufacturing process) is thus left on the right and left of the labels 12*c*.

Detector Configuration

A paper detector 26 is disposed to a paper detection position on the upstream side of the inkjet head 14 on the transportation path A. The paper detector 26 is a reflection photosensor or a transmission photosensor, and detects whether paper 12*a* is present or the type of paper 12*a* using the transmission or reflection of light from the paper 12*a* pulled through the transportation path A.

An encoder sensor 27 mounted on the carriage 15 is disposed above the transportation path A. The encoder sensor 27 functions as a linear encoder in conjunction with a linear scale that extends through the range of bidirectional movement of the carriage 15, and functions as a position detector for detecting the positions of the carriage 15 and the inkjet head 14 widthwise to the printer. Note that instead of directly detecting the amount of carriage 15 and inkjet head 14 movement using the encoder sensor 27 and linear scale, the movement of the carriage 15 and inkjet head 14 widthwise to the printer may be calculated based on the detected rotation of the carriage motor 17 to determine the positions of the carriage 15 and inkjet head 14 widthwise to the printer.

A paper width detector 29 is disposed to the carriage 15 at a position opposite the recording surface of the paper 12*a*. The paper width detector 29 is a reflection photosensor and detects the paper width in conjunction with movement of the carriage 15 widthwise to the printer (widthwise to the paper). The paper width detector 29 emits a detection beam of visible light or infrared light, for example, to the paper width detection position, and detects the left edge and right edge of the labels 12*c* on the recording paper 12*a*, or the left edge and right edge of the backing paper 12*b* used in the recording paper 12*a*, at the paper width detection position of the platen 19 using reflection of light from the platen 19 or the paper 12*a*.

Control System

Figure 4:
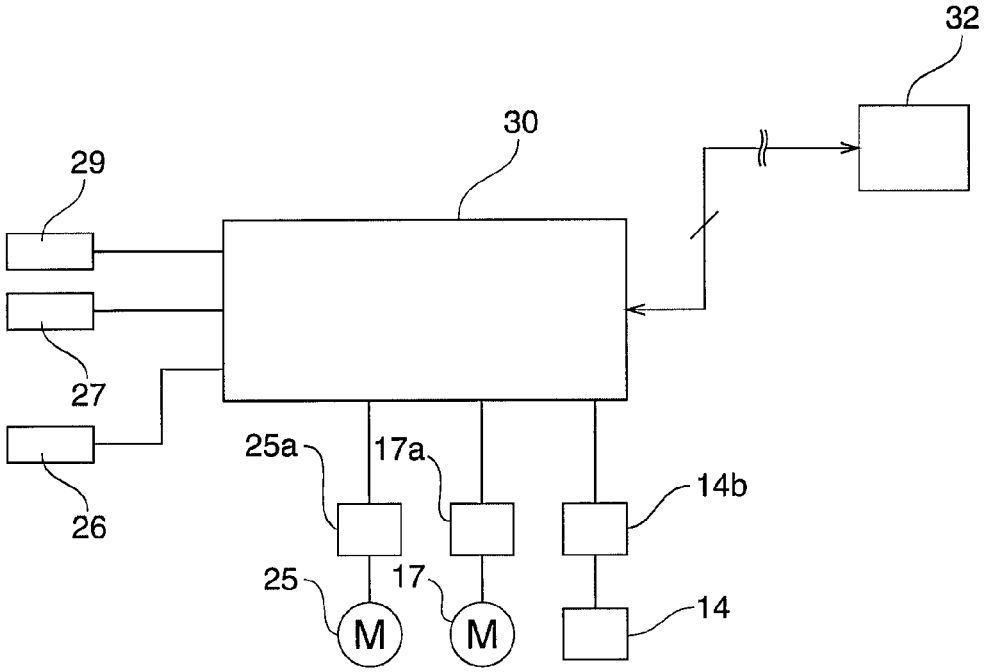
FIG. 4 is a schematic block diagram showing the control system of the label printer.

FIG. 4 is a schematic block diagram showing the control system of the label printer 1. The control system of the label printer 1 is constructed around a control unit 30 including a CPU, ROM, and RAM. Print data and commands are supplied from the host device 32 or other host terminal (an external device such as a computer) through a communication unit not shown to the control unit 30. Based on print commands and other data from the host device 32, the control unit 30 controls driving the paper feed mechanism and the carriage transportation mechanism, for example, that convey the roll paper to advance the print medium and print.

The inkjet head 14 is connected to the output side of the control unit 30 through the print head driver 14*b*, and the control unit 30 controls driving the inkjet head 14 through the print head driver 14*b*. The carriage motor 17 and paper transportation motor 25 are connected to the output side of the control unit 30 through a motor driver 17*a* and motor driver 25*a*, and the control unit 30 controls driving the paper transportation motor 25 and carriage motor 17 through the motor drivers 25*a* and 17*a*. The control unit 30 calculates the distance the paper 12*a* is conveyed by integrating the number of steps or the rotational distance that the paper transportation motor 25 is driven in the advancing direction.

The paper detector 26 is connected to the input side of the control unit 30. The control unit 30 detects if the recording paper 12*a* is present on the transportation path A at the detection position where the paper detector 26 is disposed to the transportation path A based on the detection output of the paper detector 26. The control unit 30 may alternatively execute a paper type detection operation to determine at the paper detection position the type of paper (such as the label length La and gap length Lb) that is loaded in the roll paper compartment 11. For example, the paper 12*a* that is pulled from the roll paper 12 and loaded in the transportation path A may be conveyed a predetermined distance and the type of paper that is used as the paper 12*a* may be determined based on the detection output of the paper detector 26. By controlling the parts of the label printer 1 based on the detected type of paper, the control unit 30 can also optimize the printing operation for the paper.

The encoder sensor 27 and the paper width detector 29 are also connected to the input side of the control unit 30. The control unit 30 executes the detection operation using the paper width detector 29 by controlling driving the carriage transportation mechanism to move the inkjet head 14 and the carriage 15 widthwise over the paper 12*a* set in the transportation path A. The control unit 30 compares the detection output of the paper width detector 29 with a predetermined threshold value to detect a point of change in reflectivity greater than or equal to a predetermined threshold value. The paper width of the recording paper 12*a* is determined by detecting the position where the reflectivity was detected to change based on the output of the encoder sensor 27. Alternatively, the distance from the home position of the carriage 15 to the left edge or right edge of the paper 12*a* is detected.

Paper Width Detection Process

FIG. 5A and FIG. 5B describe the paper width detection method of the label printer described above, and FIG. 6 is a flow chart of the paper width detection process.

When the power turns on or the paper is replaced, the control unit 30 of the printer 1 executes an indexing operation to position the leading end of the paper 12*a* to the print head position C in order to prepare for the next printing operation. More specifically, printing can start immediately from the leading end of the labels 12*c* once the leading end of the labels 12*c* is aligned with the print head position C. The paper width of the paper 12*a* is also detected in conjunction with this positioning operation, and the various parts of the printer 1 are controlled according to the detected paper width.

FIG. 5A shows the result of positioning the leading end of the labels 12*c* on the paper 12*a* to the print head position C at the platen 19 by this positioning operation. If a margin of a specific size is to be left at the leading end of the labels 12*c*, the labels 12*c* are positioned so that the margin is offset downstream from the print head position C.

The paper width detection position B of the paper width detector 29 is set in this label printer 1 on the upstream side from the print head position C on the transportation path A. Whether a part of a label 12*c* or whether a part of the label gap G has reached the paper width detection position B when the indexing operation ends as shown in FIG. 5A is determined by the label length La of the labels 12*c* and the gap length Lb of the label gap G. FIG. 5A shows the situation when a part of the label gap G has reached the paper width detection position B when the indexing operation ends.

The control unit 30 starts the paper width detection process after stopping the paper 12*a* when positioning is completed as shown in FIG. 5A. In step S1 in FIG. 6, the control unit 30 executes a first paper width detection operation. In the first paper width detection operation the control unit 30 starts moving the carriage 15 at a constant speed from its home position at the left end of its range of movement toward the opposite right side. The surface of the platen 19 or the surface of the paper 12*a* at the paper width detection position B is scanned using the paper width detector 29 and the reflectivity is detected at positions across the paper width. The first detection operation ends when the carriage 15 reaches the right end of its range of movement. The control unit 30 determines if the change in the detected reflectivity is greater than or equal to a predetermined threshold value at each detection point across the paper width, and detects points where the change in reflectivity is greater than or equal to a predetermined threshold value.

Of these points of change, the position of the point of change closest to the left side is identified as the position of the left edge of the paper 12*a*, and position of the point of change closest to the right side is identified as the position of the right edge of the paper 12*a*. In other words, the position of the first point of change in the scanning direction is determined to be the position of the left edge of the paper 12*a*, and the position of the last point of change in the scanning direction is determined to be the position of the right edge of the paper 12*a*. If the scanning direction is reversed, the position of the first point of change in the scanning direction is determined to be the position of the right edge of the paper 12*a*, and the position of the last point of change in the scanning direction is determined to be the position of the left edge of the paper 12*a*.

In this detection operation the paper width detector 29 mounted on the carriage 15 scans the area from at least a first position P1 at the left end of the platen 19 to a second position P2 at the right end of the platen 19, and detects the points of change in reflectivity through this range from first position P1 to second position P2. Note that the first position P1 is set to a position further to the left side from the left edge of paper 12*a* with the maximum paper width, and the second position P2 is set to a position further to the right side from the right edge of paper 12*a* with the maximum paper width.

Figure 6:
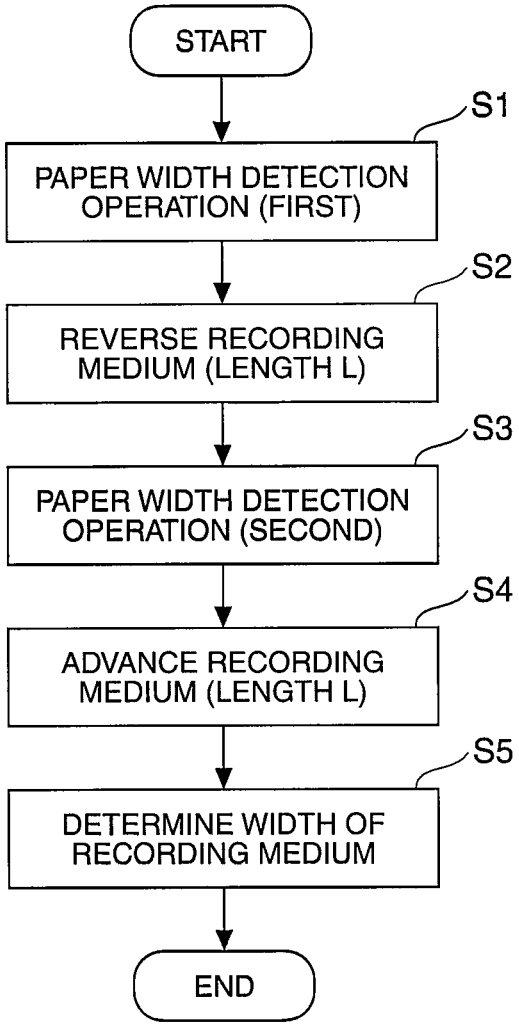
FIG. 6 is a flow chart of the paper width detection method of the lap.

The control unit 30 then goes to step S2 in FIG. 6 and conveys the paper 12*a* transportation distance L in reverse by causing the paper transportation motor 25 to turn a specific amount in reverse. Note that this transportation distance L is determined by the relationship between label length La and gap length Lb, and is set so that La>L>Lb. Note, further, that the transportation distance L can usually be set this way because the label gap G is normally shorter than the label length La, but if La≤Lb, then the transportation distance L is set so that L>Lb+Lc (where Lc<La).

FIG. 5B shows the result of the transportation process in step S2. As shown, by reversing the paper 12*a* transportation distance L where La>L>Lb, a part near the trailing end of the label 12*c* that was on the downstream side of the paper width detection position B when the indexing step ended in FIG. 5A has moved to the paper width detection position B.

The control unit 30 then goes to step S3 in FIG. 6 and executes a second paper width detection operation. More specifically, the control unit 30 returns the carriage 15 from the right end of the range of movement where the first paper width detection operation ended to the home position at the left end of this range, and then executes a detection operation identical to the first paper width detection operation. As a result, the points where the change in reflectivity is greater than or equal to the predetermined threshold value in the scanning range of the paper width detector 29 are detected again. The position of the point of change closest to the left side is identified as the position of the left edge of the paper 12*a*, and position of the point of change closest to the right side is identified as the position of the right edge of the paper 12*a*.

After the second paper width detection operation ends, the control unit 30 goes to step S4 in FIG. 6 and advances the paper 12*a* from the position to which it was reversed in step S2 to return the paper 12*a* to the printing start position again. More specifically, the paper 12*a* is conveyed forward by transportation distance L by causing the paper transportation motor 25 to turn a specific amount forward.

The control unit 30 then determines the paper width of the recording paper 12*a* in step S5 in FIG. 6 based on the results of the first and second paper width detection operations. More specifically, the control unit 30 compares the positions determined to be the position of the left edge of the paper 12*a* in the first and second paper width detection operations, and uses the position that is farthest left or the position that is closest to the first position P1. Likewise, the control unit 30 compares the positions determined to be the position of the right edge of the paper 12*a* in the first and second paper width detection operations, and uses the position that is farthest right or the position that is closest to the second position P2. The distance between the selected left edge position and right edge position is determined to be the paper width of the recording paper 12*a*.

As described above, because the paper width detection method according to this embodiment of the invention executes the paper width detection operation that scans over the transportation path A in the paper width direction by the paper width detector 29 not once but twice, and conveys the paper 12*a* transportation distance L, which is longer than the gap length Lb of the label gap G and is shorter than the label length La of the labels 12*c*, between the first and second paper width detection operations, the paper width detection result will be obtained at least once when a label 12*c* is stopped at the paper width detection position B.

Because the reflectivity of the liner is low when the die-cut label paper uses a transparent backing paper 12*b* as the liner, it may not be possible to detect the point where the reflectivity changes at the edges of the liner when the paper width detector 29 is a reflection photosensor, but the method of this embodiment of the invention can detect at least the width of the label 12*c* part in either the first or the second paper width detection operation. It is therefore more difficult for errors, such as not being able to detect the paper width, to occur. Furthermore, because the detected value can be used if an accurate right edge or left edge position can be detected at least once from either of the two operations, the accuracy of detecting the paper width of the paper 12*a* can also be improved. The paper width of the recording paper 12*a* can therefore be detected more accurately than in the related art. Note, further, that the paper width detection operation can be executed three or more times to detect the left edge position at the farthest left side and the right edge position at the farthest right side.

The paper width detection operation according to this embodiment of the invention scans the area from at least a first position P1 farther to the left than the left edge of the recording paper 12*a* to a second position P2 farther to the right than the right edge of the paper 12*a*, and detects the points of change in reflectivity through this range. The paper width of the recording paper 12*a* is then determined by using the detected point of change that is farthest to the left side or is closest to the first position P1 as the position of the left edge of the paper 12*a*, and using the point that is farthest to the right side or is closest to the second position P2 as the position of the right edge of the paper 12*a*. Therefore, insofar as the edges of the paper 12*a* are detected as points where the detected reflectivity changed, even if a point where the reflectivity changed is detected therebetween due to soiling or damage to the paper 12*a*, such points can be determined to not be edges of the paper 12*a*, and false edge detection can be prevented.

More specifically, because slit-like process marks are formed by the die cutting process along the outside edges of the labels 12*c* when the recording paper 12*a* is die-cut label paper, there is a strong possibility that the edges of a label 12*c* will be detected as a point of change in reflectivity, but as long as an edge of the backing paper 12*b* is detected further to the left side or right side, the paper width can still be accurately detected.

With the method described above the first paper width detection operation is executed after conveying the paper 12*a* to a final indexed position at the end of the positioning process, and the paper 12*a* is then fed in reverse to execute the second paper width detection operation. However, conveying the paper 12*a* may be stopped distance L before the final indexed position and the first paper width detection operation may be executed before advancing the paper 12*a* to the final indexed position and executing the second paper width detection operation. This configuration eliminates the need to reverse the paper 12*a*.

In addition, the distance between the detected left edge position and right edge position may be calculated as the paper width in the paper width detection operations in steps S1 and S3, and step S5 may compare the paper widths detected in the first and second paper width detection operations and use the larger paper width as the paper width of the recording paper 12*a*.

Printing Control

After the paper width detection process ends the label printer 1 enters a printing standby mode. When print data is then received from the host device 32, the label printer 1 executes paper transportation and printing operations to print the received print data. During this time the control unit 30 controls the parts of the label printer 1 using the paper width information detected by the paper width detection process described above. Printing control based on the detected paper width information is described next.

First, the control unit 30 interprets the received print data, and then acquires the paper width information for the paper 12*a* used for printing. The received paper width and the paper width of the set paper 12*a* detected by the foregoing paper width detection process are then compared, and whether the paper width of the set paper 12*a* is a paper width enabling printing the received print data is determined. Printing proceeds if the data is determined to be printable, but if printing is determined to not be possible, a paper size error has occurred and an appropriate error handling process executes.

Figure 7:
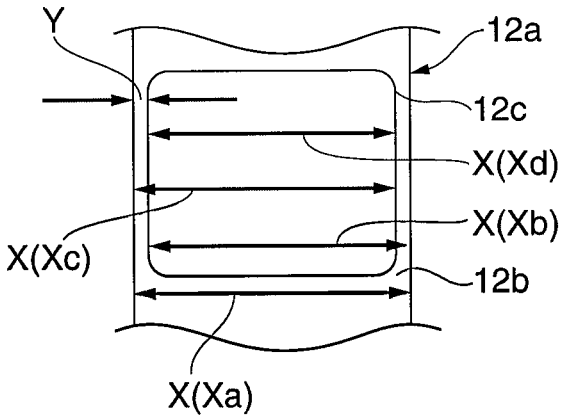
FIG. 7 describes a method of detecting a paper size error.

Determining if printing is possible or not is based on decision standards such as described below. FIG. 7 describes a paper size error determination process using die-cut label paper. Because the paper 12*a* is die-cut label paper using a transparent backing paper 12*b* as the liner, an edge of the backing paper 12*b*, or an edge part of the label 12*c*, may be detected as an edge of the paper 12*a*. The paper width X detected by the paper width detection process described above is therefore one of four patterns: the width Xa of the backing paper 12*b*, the width Xb from the left edge of the label 12*c* to the right edge of the backing paper 12*b*, the width Xc from the left edge of the backing paper 12*b* to the right edge of the label 12*c*, or the width Xd from the left edge to the right edge of the label 12*c*.

If Y is the width of the liner on the left and right sides of the label 12*c* (that is, the width of the waste matrix), and width Xd, which is the narrowest width of the four patterns described above, is measured as the detected paper width, the maximum paper width X that can result from this detected paper width is Xd+2Y+Z (where Z is the detection accuracy of the paper width detector 29). If the received paper width is greater than this maximum paper width, the print data can therefore be expected to overflow from the edges of the paper 12*a*.

The control unit 30 therefore subtracts the detected paper width X from the received paper width, and determines if the difference is greater than 2Y+Z. If the difference is greater than 2Y+Z, a paper size error has occurred. If the difference is less than or equal to 2Y+Z, the received print data can be printed. Note that alternatively a paper size error may always be returned when the detected paper width and the received paper width do not match.

The error handling process executed when a paper size error results may, for example, stop operation of the label printer 1 and send an error report to the host device 32, or may cause an error indicator on the label printer 1 to light. If operation is stopped when a paper size error occurs, the problem of not being able to print the print data as intended can be prevented, and wasteful consumption of paper and ink can be prevented.

Figure 8:
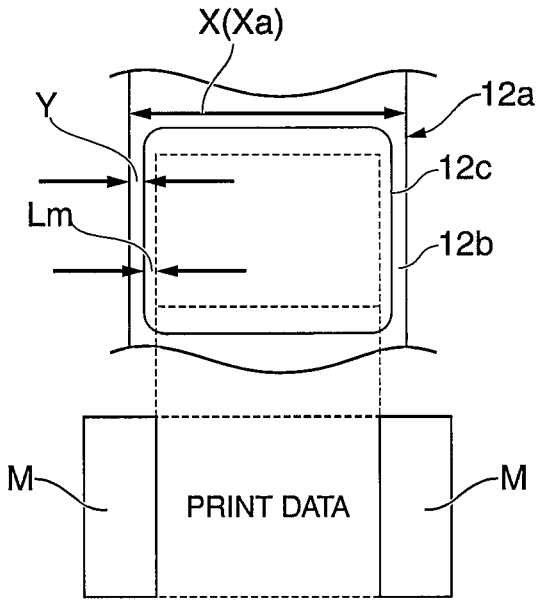
FIG. 8 describes the print data mask area.

A masking process that does not print the print data that exceeds the width of the set paper 12*a* may also be executed as the error handling process when a paper size error results. FIG. 8 describes the print data masking area.

The masking process assumes that, of the four possible detected paper width values described above, width Xa, which is the width of the widest backing paper 12*b*, is detected. The width of the printing area of the label when the size of the left and right margins of the label 12*c* is Lm is calculated as Xa−2Y−2Lm. Whether the printing width of the received print data is greater than the width of the printing area calculated from this equation is then determined, and if the received printing width is greater, the portion outside this printing area is set as the mask area M. More specifically, the portion at the left and right ends is set as the mask area M, leaving only the part of width Xa−2Y−2Lm in the middle of the print data.

If the mask area M is thus determined and the inkjet head 14 is then controlled to not discharge ink in the mask area M, the print data that would exceed the printing area of the label 12*c* can be processed to not print. Ink will therefore not be discharged directly onto the platen 19, and the platen 19 can be prevented from being soiled by ink. Note that if the label 12*c* is printed with no border (margin) there is no need to consider margin size Lm. Furthermore, if it is sufficient to prevent discharging ink onto the platen 19, it is also not necessary to consider the width Y of the waste matrix, and it is enough to simply not print the print data for the part exceeding the detected paper width of the paper 12*a*.

Note that while preventing paper width detection errors and improving detection precision are described using a transparent backing paper 12*b* as the liner by way of example in the foregoing embodiment, the same effect can also be achieved with label paper using a liner with low reflectivity, such as a black liner.

The foregoing embodiment of the invention has been described using a reflection photosensor as the paper width detector 29, but a transmission photosensor that detects the detection beam passing through the paper 12*a* and detects the transmittance of the paper 12*a*, or a different type of sensor, may be used as the paper width detector 29 instead. If a transmission photosensor is used, a photodetection unit having an array of photodetectors through the scanning range of the photoemitters may be disposed.

Detecting the edges of the liner by a transmission photosensor is difficult in this situation if a transparent backing paper 12*b* is used as the liner of the die-cut label paper because the transmittance of the detection beam (visible light) from the transmission photosensor is high at the liner, but the likelihood of being able to detect the width of at least the label 12*c* part is high with the paper width detection method described above in the same way as when a reflection photosensor is used. Paper width detection failures therefore do not occur easily, and the paper width of the recording paper 12*a* can be detected more reliably than in the related art.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A paper width detection method for a label printer, comprising:

conveying a recording medium that has a continuous transparent liner with removably affixed labels along a transportation path in a first direction to a first predetermined position;

detecting the recording medium in a paper width direction at the first predetermined position;

conveying the recording medium a distance along the transportation path in a second direction opposite the first direction to a second predetermined position, wherein the distance is longer than a gap between adjacent labels affixed to the recording medium;

detecting the recording medium in the paper width direction at the second predetermined position;

determining a label width based on points of change in at least one of the detecting at the first predetermined position and the detecting at the second predetermined position;

conveying the recording medium along the transportation path in the first direction toward the first predetermined position; and printing on the label based on the determined label width and the first predetermined position.

2. The paper width detection method for a label printer described in claim 1, wherein:

a scanning range of a paper width detector used to detect the recording medium at any of the first predetermined position and the second predetermined position includes a maximum paper width of the recording medium, and the method further including selecting, from among a plurality of detecting positions where change greater than or equal to a specific amount appears in an output of the paper width detector, wherein:

a first detecting position is set as the position of a first edge of the label, and a last detecting position is set as the position of a second edge of the label.

3. The paper width detection method for a label printer described in claim 1, wherein:

a paper width detector used to detect the recording medium at any of the first predetermined position and the second predetermined position is an optical detector on a carriage that carries a printing head and moves in the paper width direction.

4. The paper width detection method for a label printer described in claim 1, wherein:

the label is a die-cut type that has a mark of a specific depth formed around outside edge.

5. A label printer comprising:

a transportation path configured to pass a recording medium that has a continuous transparent liner with removably affixed labels;

a recording medium transportation mechanism configured to set the recording medium at a first predetermined position on the transportation path, reverse the recording medium a distance that is longer than a gap between adjacent labels affixed to the recording medium to a second predetermined position, and advance the recording medium toward the first predetermined position;

a paper width detector configured to move in the paper width direction, detect the recording medium at the first predetermined position as a first detecting, and detect the recording medium at the second predetermined position as a second detecting; and a controller configured to determine a label width based on points of change in at least one of the first detecting and the second detecting and print on the label based on the determined label width and the first predetermined position.

6. The label printer described in claim 5, wherein:

a scanning range of the paper width detector used to detect the recording medium at any of the first predetermined position and the second predetermined position includes a maximum paper width of the recording medium; and the controller is further configured to select from among a plurality of detecting positions where change greater than or equal to a specific amount appears in an output of the paper width detector, and a first detecting position is set as the position of a first edge of the label and a last detecting position is set as the position of a second edge of the label.

7. The label printer described in claim 5, wherein:

the paper width detector is an optical detector on a carriage that carries a printing head and moves in the paper width direction.

8. The label printer described in claim 1, wherein:

the label is a die-cut type that has a mark of a specific depth formed around outside edge.

* * * * *